US007942760B2

(12) United States Patent
Best et al.

(10) Patent No.: US 7,942,760 B2
(45) **Date of Patent: *May 17, 2011**

(54) TRANSITIONING HOLLOW GOLF CLUBS

(75) Inventors: Christopher B. Best, Encinitas, CA (US); Ryan L. Roach, Cardiff-by-the-sea, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/585,230

(22) Filed: Oct. 24, 2006

(65) Prior Publication Data

US 2007/0042836 A1 Feb. 22, 2007

Related U.S. Application Data

(60) Division of application No. 10/902,065, filed on Jul. 30, 2004, now Pat. No. 7,147,571, which is a continuation-in-part of application No. 10/828,219, filed on Apr. 21, 2004, now Pat. No. 7,137,903.

(51) Int. Cl.
*A63B 53/04* (2006.01)

(52) U.S. Cl. ..... 473/345; 473/350

(58) Field of Classification Search ..... 473/287–291, 473/345–346, 332, 350

See application file for complete search history.

(56) References Cited

U.S. PATENT DOCUMENTS

| | | | | |
|---|---|---|---|---|
| 4,128,242 | A * | 12/1978 | Elkins, Jr. | 473/291 |
| 4,582,321 | A | 4/1986 | Yoneyama | |
| 4,645,207 | A * | 2/1987 | Teramoto et al. | 473/290 |
| 4,754,969 | A | 7/1988 | Kobayashi | 473/290 |
| 4,824,110 | A | 4/1989 | Kobayashi | 473/332 |
| 4,848,747 | A | 7/1989 | Fujimura et al. | |
| 4,928,972 | A | 5/1990 | Nakanishi et al. | |
| 4,964,640 | A | 10/1990 | Nakanishi et al. | 473/335 |
| 5,209,473 | A | 5/1993 | Fisher | |
| 5,413,336 | A * | 5/1995 | Iwanaga | 473/291 |
| 5,417,419 | A * | 5/1995 | Anderson et al. | 473/329 |
| 5,674,132 | A | 10/1997 | Fisher | |
| 5,766,092 | A | 6/1998 | Mimeur et al. | |
| 5,823,887 | A | 10/1998 | Mikame et al. | |
| 5,899,821 | A | 5/1999 | Hsu et al. | 473/332 |
| 6,030,293 | A | 2/2000 | Takeda | 473/329 |

(Continued)

FOREIGN PATENT DOCUMENTS

JP 59-190268 12/1984

(Continued)

*Primary Examiner* — Stephen L. Blau

(74) *Attorney, Agent, or Firm* — Knobbe, Martens, Olson & Bear, LLP

(57) ABSTRACT

The present invention relates to a set of golf club irons in which some of the club heads have a hollow space, and some of the club heads do not have a hollow space. The hollow space is preferably defined by a lower portion of the front face, a portion of the sole, and a rear wall. The presence of the hollow space moves the club head center of gravity back (away from the face) and down (toward the sole), making it easier to get a golf ball airborne. The volumes of the hollow spaces generally transition or get progressively smaller with an increase in the club loft angle, thus altering the center of gravity location and moments of inertia by different amounts for different clubs. The hollow spaces may be empty or filled, in whole or part.

18 Claims, 5 Drawing Sheets

U.S. PATENT DOCUMENTS

| | | | | |
|---|---|---|---|---|
| 6,093,112 | A | 7/2000 | Peters et al. | |
| 6,179,726 | B1 | 1/2001 | Satoh et al. | |
| 6,196,934 | B1 * | 3/2001 | Sherwood | 473/290 |
| 6,344,001 | B1 | 2/2002 | Hamada et al. | 473/329 |
| 6,482,104 | B1 | 11/2002 | Gilbert | |
| 6,530,846 | B1 * | 3/2003 | Mase | 473/290 |
| 6,547,675 | B2 | 4/2003 | Sherwood | |
| 6,811,496 | B2 | 11/2004 | Wahl et al. | |
| 6,814,674 | B2 | 11/2004 | Clausen et al. | |
| 6,830,519 | B2 | 12/2004 | Reed et al. | |
| 6,860,819 | B2 | 3/2005 | Gilbert | |
| 6,984,180 | B2 * | 1/2006 | Hasebe | 473/291 |
| 6,991,559 | B2 | 1/2006 | Yabu | |
| 2001/0014628 | A1 | 8/2001 | Erickson et al. | |
| 2002/0098910 | A1 | 7/2002 | Gilbert | |
| 2002/0119828 | A1 | 8/2002 | Toulon et al. | |
| 2003/0134692 | A1 * | 7/2003 | Nakahara et al. | 473/345 |
| 2003/0176232 | A1 * | 9/2003 | Hasebe | 473/291 |
| 2003/0228928 | A1 * | 12/2003 | Yabu | 473/290 |
| 2005/0014573 | A1 * | 1/2005 | Lee | 473/291 |

FOREIGN PATENT DOCUMENTS

| | | | |
|---|---|---|---|
| JP | 62-240695 | 3/1989 | |
| JP | 63-081686 | 10/1989 | |
| JP | 63-152968 | 12/1989 | |
| JP | 2-118576 | 9/1990 | |
| JP | 03-078393 | 10/1992 | |
| JP | 03-151944 | 4/1993 | |
| JP | 03-269387 | 4/1993 | |
| JP | 04-179949 | 8/1993 | |
| JP | 04-339134 | 12/1993 | |
| JP | 04-339135 | 12/1993 | |
| JP | 6-26637 | 4/1994 | |
| JP | 04-343382 | 6/1994 | |
| JP | 05-108879 | 10/1994 | |
| JP | 06-296715 | 10/1994 | |
| JP | 05-156187 | 12/1994 | |
| JP | 05-167146 | 1/1995 | |
| JP | 06-130626 | 1/1995 | |
| JP | 05-181685 | 2/1995 | |
| JP | 05-248195 | 4/1995 | |
| JP | 06-051834 | 10/1995 | |
| JP | 06-063532 | 10/1995 | |
| JP | 06-063538 | 10/1995 | |
| JP | 06-227187 | 2/1996 | |
| JP | 06-202394 | 3/1996 | |
| JP | 06-234100 | 3/1996 | |
| JP | 07-204924 | 2/1997 | |
| JP | 9-75481 | 3/1997 | |
| JP | 3038925 | 4/1997 | |
| JP | 07-318377 | 6/1997 | |
| JP | 08-056659 | 8/1997 | |
| JP | 08-065456 | 9/1997 | |
| JP | 08-076774 | 10/1997 | |
| JP | 08-175044 | 1/1998 | |
| JP | 08-192156 | 1/1998 | |
| JP | 09-086801 | 10/1998 | |
| JP | 09-111131 | 11/1998 | |
| JP | 10-112182 | 12/1998 | |
| JP | 10-023813 | 8/1999 | |
| JP | 10-037557 | 8/1999 | |
| JP | 10-337751 | 9/1999 | |
| JP | 11-019210 | 10/1999 | |
| JP | 10-109175 | 11/1999 | |
| JP | 10-182142 | 1/2000 | |
| JP | 10-196130 | 1/2000 | |
| JP | 10-203804 | 2/2000 | |
| JP | 2000-107334 | 4/2000 | |
| JP | 2000-111956 | 4/2000 | |
| JP | 11-031683 | 8/2000 | |
| JP | 11-055876 | 9/2000 | |
| JP | 11-096984 | 10/2000 | |
| JP | 11-108206 | 10/2000 | |
| JP | 11-169109 | 12/2000 | |
| JP | 2000-373162 | 12/2000 | |
| JP | 11-209462 | 2/2001 | |
| JP | 11-261336 | 3/2001 | |
| JP | 11-351651 | 6/2001 | |
| JP | 11-351652 | 6/2001 | |
| JP | 11-351653 | 6/2001 | |
| JP | 2000-011007 | 7/2001 | |
| JP | 2000-021352 | 7/2001 | |
| JP | 2000-026912 | 8/2001 | |
| JP | 2000-032602 | 8/2001 | |
| JP | 2000-048736 | 8/2001 | |
| JP | 2001-255631 | 8/2001 | |
| JP | 11-275541 | 10/2001 | |
| JP | 2001-320476 | 10/2001 | |
| JP | 2001-340501 | 12/2001 | |
| JP | 2000-229380 | 2/2002 | |
| JP | 2000-252704 | 3/2002 | |
| JP | 2000-252705 | 3/2002 | |
| JP | 2000-285736 | 3/2002 | |
| JP | 2002-086867 | 3/2002 | |
| JP | 2000-301075 | 4/2002 | |
| JP | 2002-106802 | 4/2002 | |
| JP | 2002-113133 | 4/2002 | |
| JP | 2000-395459 | 7/2002 | |
| JP | 2000-402020 | 7/2002 | |
| JP | 2001-168462 | 12/2002 | |
| JP | 2001-229753 | 2/2003 | |
| JP | 2001-241507 | 2/2003 | |
| JP | 2003-52870 | * 2/2003 | |
| JP | 2001-264988 | 3/2003 | |
| JP | 2001-305669 | 4/2003 | |
| JP | 2001-342300 | 5/2003 | |
| JP | 2001-396209 | 5/2003 | |
| JP | 2002-019394 | 8/2003 | |
| JP | 2002-229471 | 8/2003 | |
| JP | 2002-180277 | 1/2004 | |
| JP | 2004-8565 | 1/2004 | |
| JP | 2004-81241 | 3/2004 | |

* cited by examiner

TRANSITIONING HOLLOW GOLF CLUBS

CROSS-REFERENCE TO RELATED APPLICATIONS

This application is a divisional of U.S. patent application Ser. No. 10/902,065, filed Jul. 30, 2004, now U.S. Pat. No. 7,147,571, which is a continuation-in-part of U.S. patent application Ser. No. 10/828,219, filed on Apr. 21, 2004, now U.S. Pat. No. 7,137,903, which are incorporated herein by reference in their entirety.

BACKGROUND OF THE INVENTION

1. Field of the Invention

The present invention relates to golf clubs, and, more particularly, to a set of golf club irons having a transitioning hollow space.

2. Description of the Related Art

Iron type golf clubs generally include a front or striking face, a top line, and a sole. The front face interfaces with and strikes the golf ball. A plurality of score lines or grooves is positioned on the face to assist in imparting spin to the ball. The top line is generally configured to have a particular look to the golfer and to provide weight. The sole of the golf club is particularly important to the golf shot because it contacts and interacts with the ground during the golf shot.

In conventional sets of iron-type golf clubs, each club includes a shaft with a club head attached to one end and a grip attached to the other end. The club head includes a face for striking a golf ball. The angle between the face and a vertical plane is called the loft angle.

The set generally includes irons that are designated number 2 through number 9, and a pitching wedge. Other wedges, such as a lob wedge, a gap wedge, and a sand wedge, may be optionally included with the set. Each iron has a shaft length that usually decreases through the set as the loft for each club head increases from the long irons to the short irons. The length of the club, along with the club head loft and center of gravity location, impart various performance characteristics to the ball's launch conditions upon impact and determine the distance the ball will travel. Flight distance generally increases with a decrease in loft angle and an increase in club length. However, difficulty of use also increases with a decrease in loft angle and an increase in club length.

Iron-type golf clubs generally can be divided into two categories: blades and cavity backs. Blades are traditional clubs with a substantially uniform appearance from the sole to the top line, although there may be some tapering from sole to top line.

Since blade designs have a small sweet spot (that is, the area of the face that results in a desirable golf shot upon striking a golf ball), they are relatively difficult to use and are therefore typically only used by skilled golfers. However, since these designs are less forgiving than cavity backs, they allow a skilled golfer to work the ball and shape the golf shot as desired.

Cavity backs are modern designs that move some of the club mass to the perimeter of the club by providing a hollow or cavity in the back of the club, opposite the striking face. This produces a more forgiving club with a larger sweet spot. Moving weight to the perimeter also allows the size of the club face to be increased. The perimeter weighting created by the cavity also increases the club's moment of inertia, which is a measurement of the club's resistance to torque, for example the torque resulting from an off-center hit. Because of the increased moment of inertia and larger face area, these clubs are easier to hit than blades, and are therefore usable by less-skilled and beginner golfers.

SUMMARY OF THE INVENTION

The present invention relates to a set of golf club irons in which some of the club heads have a hollow space, and some of the club heads do not have a hollow space. The hollow space is preferably defined by a lower portion of the front face, a portion of the sole, and a rear wall. The hollow spaces generally transition or get progressively smaller with an increase in the club loft angle. The hollow spaces may be empty or filled, at least in part, such as with a foam. An adhesive may also be provided within the hollow spaces.

The back of the front face may include an upper rear cavity. The back of the club head may include a lower rear cavity. The lower rear cavity may be provided within the rear wall for those of the clubs that have a rear wall, or in the rear surface of the front face for those of the clubs that do not have a rear wall. These cavities may be left open, or they may be fitted with an insert therein.

The front face, in conjunction with a vertical plane passing through the leading edge of the front face, defines the club loft angle. The sole is coupled to the front face at the leading edge. Preferably, the width of the sole, as measured in a direction from the front of the club head to the back of the club head, is substantially constant throughout the set. The rear wall is coupled to the sole at a lower junction, and to a rear surface opposite the front wall defining the front face at an upper junction. The lower junction is preferably between the leading edge and the trailing edge of the club head. The lower junction is at a predetermined distance from the lower edge of the front face. Preferably, the predetermined distances decrease through the set with an increase in loft angle.

Each of the hollow spaces defines a volume, and the volumes of the hollow spaces generally decrease with an increase in loft angle. Optionally, the volumes of at least two of the club heads are substantially identical.

The set contains long-distance clubs and short-distance clubs. Those of the clubs that have a hollow space include long-distance clubs, and those of the clubs that do not have a hollow space include short-distance clubs. Alternatively, those of the clubs that have a hollow space are long-distance clubs and those of the clubs that do not have a hollow space are short-distance clubs; that is, only the long-distance clubs have hollow spaces.

Each of the club heads has a center of gravity. Each center of gravity preferably is less than 1 inch from a bottom of the sole, and more preferably, each center of gravity is less than 0.8 inch from the bottom of the sole. Each center of gravity is from approximately 0.4 inch to approximately 0.6 inch behind the front face, and more preferably, each center of gravity is approximately 0.5 inch behind the front face. Each club head has a moment of inertia as measured about a vertical axis passing through the center of gravity that is within the range of approximately 2300 $g \cdot cm^2$ to approximately 2900 $g \cdot cm^2$. The moments of inertia generally increase with an increase in loft angle.

DESCRIPTION OF THE DRAWINGS

The present invention is described with reference to the accompanying drawings, in which like reference characters reference like elements, and wherein.

DETAILED DESCRIPTION OF THE INVENTION

Figure 1:
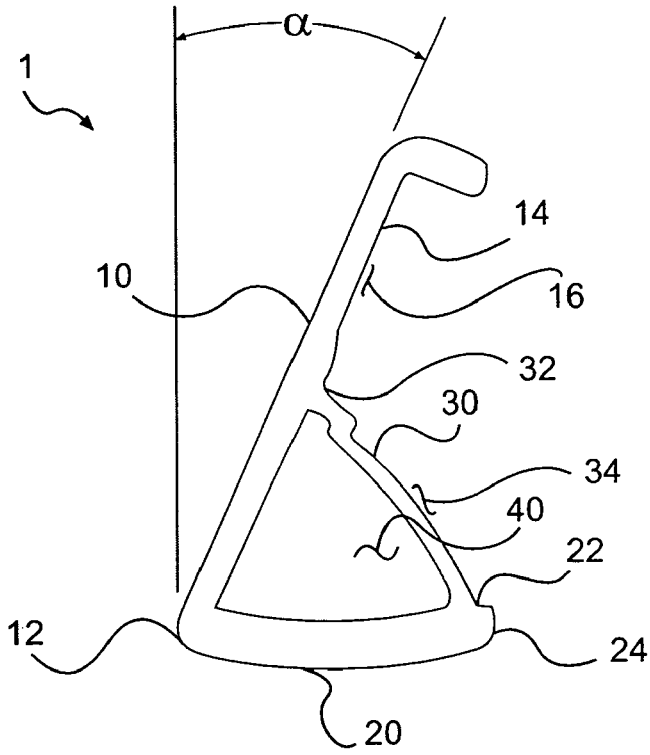
FIG. 1 shows a cross-sectional view through a first representative club of a set of golf clubs of the present invention.

Other than in the operating examples, or unless otherwise expressly specified, all of the numerical ranges, amounts, values and percentages such as those for amounts of materials, moments of inertias, center of gravity locations, loft angles and others in the following portion of the specification may be read as if prefaced by the word "about" even though the term "about" may not expressly appear with the value, amount or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

A set of golf clubs typically includes irons that are designated number 2 through number 9, and a pitching wedge. Other sets, for example a set of lady's golf clubs, typically include irons designated number 4 through number 9, and a pitching wedge. The loft angle of the clubs increases with an increase in designation number. For example, a 2-iron has a smaller loft angle than a 5-iron, and a 5-iron has a smaller loft angle than a pitching wedge. Generally, difficulty of use increases with a decrease in loft angle. Thus, it follows that a 2-iron is more difficult to hit than a 5-iron, and a 5-iron is more difficult to hit than a pitching wedge.

The longer irons (that is, irons with a smaller loft angle) are generally difficult to hit due to having a smaller sweet spot. Thus, it is desirable to produce irons with a bigger sweet spot.

The present invention provides a set of golf clubs that balance the sweet spot size individually for each club. This is achieved by increasing the sweet spot size for the clubs that are harder to hit (the long-distance irons) and maintaining a smaller sweet spot for the clubs that are easier to hit (the short-distance irons). The set includes a plurality of iron-type golf club heads in which some of the club heads have a hollow space, and some of the club heads do not have a hollow space. The volumes of the hollow spaces generally transition or get progressively smaller with an increase in the club loft angle. The presence of the hollow space moves the club head center of gravity back (away from the face) and down (toward the sole), making it easier to get a golf ball airborne. The hollow space preferably is varied to provide different amounts of alteration for different clubs.

FIG. 1 shows a cross-sectional view through a first representative club 1 of a set of golf clubs of the present invention. The club 1 is an iron-type club and includes a front face 10, a sole 20, and a rear wall 30. The front face 10, in conjunction with a vertical plane passing through a leading edge 12 of the front face 10, defines the club loft angle $\alpha$. The sole 20 is coupled to the front face 10 at the leading edge 12. Preferably, the width of the sole 20, as measured in a direction from a front of the club head 1 to a back of the club head 1, is substantially constant throughout the set. The rear wall 30 is coupled to the sole 20 at a lower junction 22, and to a rear surface 14 opposite the front wall defining the front face 10 at an upper junction 32. The lower junction 22 is preferably between the leading edge 12 and the trailing edge 24 of the club head 1.

The club 1 is one of the longer clubs of the set, and, accordingly, it includes a hollow space 40. The hollow space 40 is defined by a lower portion of the front face 10, a portion of the sole 20, and the rear wall 30. (The rear wall 30 is only present in those clubs containing a hollow space 40.) The hollow space 40 moves the club head center of gravity back and down, enlarging the sweet spot. The bigger the volume of the hollow space, the greater the effect on the center of gravity location. Since the clubs get progressively easier to hit with an increase in loft angle, the need to move the center of gravity progressively decreases with an increase in loft angle. Therefore, the volumes of the hollow spaces 40 generally transition or get progressively smaller with an increase in the club loft angle. The hollow spaces 40 may be empty or filled, at least in part, such as with a foam. An adhesive may also be provided within the hollow spaces 40 to prevent any foreign matter that may be located therein from moving, which may be distracting to the user.

As an additional means for lowering the club head center of gravity, the front face 10 preferably is tapered, being thicker toward the bottom and thinner toward the top. Similarly, the thickness and weight of the sole 20 can be manipulated to further influence the center of gravity location.

The hollow space 40 also affects the club head moment of inertia (MOI). Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases.

The hollow space 40 also moves the weight of the club head outward, toward the perimeter of the club head. This perimeter weighting increases the club MOI, making it more forgiving for off-center hits.

Figure 2:
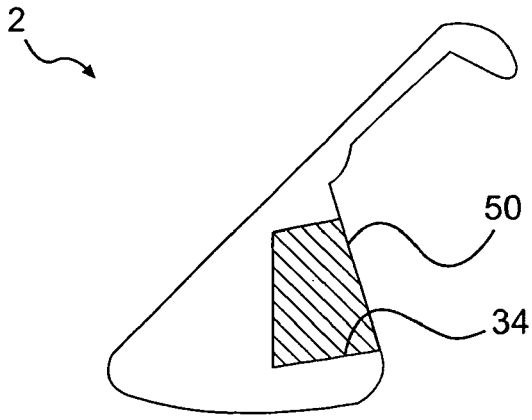
FIG. 2 shows a cross-sectional view through a second representative club of a set of golf clubs of the present invention.

The back of the front face 10 may include an upper rear cavity 16. The back of the club head 1 may include a lower rear cavity 34. The lower rear cavity 34 may be provided within the rear wall 30 for those of the clubs that have a rear wall 30, or in the rear surface opposite the front wall defining the front face 10 for those of the clubs that do not have a rear wall 30. These rear cavities 16, 34 act to further distribute the club head mass to the club head perimeter to enlarge the sweet spot, further facilitating the golf swing and producing a more forgiving club head with a softer feel. These cavities may be left open, or they may be fitted with an insert therein. Contemplated inserts include a weight insert and a composite insert. Composite materials may include various resins combined with matrix material, for example thermoplastic or thermosetting resins or the like combined with a fiber glass, graphite, or ceramic matrix or the like. A logo may preferably be placed on the insert. FIG. 2 shows a cross-sectional view through a second representative club 2 of a set of golf clubs of the present invention. The club 2 is one of the shorter clubs of the set, and, accordingly, it does not include a hollow space. An insert 50 has been positioned within the lower rear cavity 34.

Preferably, the center of gravity for each club is less than 1 inch from the bottom of the sole 20, and more preferably the center of gravity for each club is less than 0.8 inch from the bottom of the sole 20. Preferably, the center of gravity for each club is from approximately 0.4 inch to approximately 0.6 inch behind the front face 10, and more preferably the center of gravity for each club is approximately 0.5 inch behind the front face 10. Preferably, the moment of inertia for each club is from approximately 2300 $g \cdot cm^2$ to approximately 2900 $g \cdot cm^2$. The moments of inertia preferably increase with an increase in loft angle.

The hollow space may be formed by casting a club head shell around a device, such as a solid part or an inflatable bladder, and subsequently removing the device through a hole in the sole 20. A sole insert may then be coupled to the club head shell, such as by welding, to enclose the hollow space 40. The sole insert material may be relatively more dense than the material of the rest of the club head 1, thereby further lowering the club head center of gravity and enlarging the sweet spot. The sole insert may be formed by any suitable manufacturing process, such as by forging or casting. Contemplated materials for the club head shell include stainless steels, and contemplated materials for the sole insert include stainless steels and tungsten alloys.

These and other aspects of the present invention may be more fully understood with reference to the following non-limiting examples, which are merely illustrative of the preferred embodiment of the present invention set of golf clubs, and are not to be construed as limiting the invention, the scope of which is defined by the appended claims and their equivalents.

EXAMPLE 1

Figure 3:
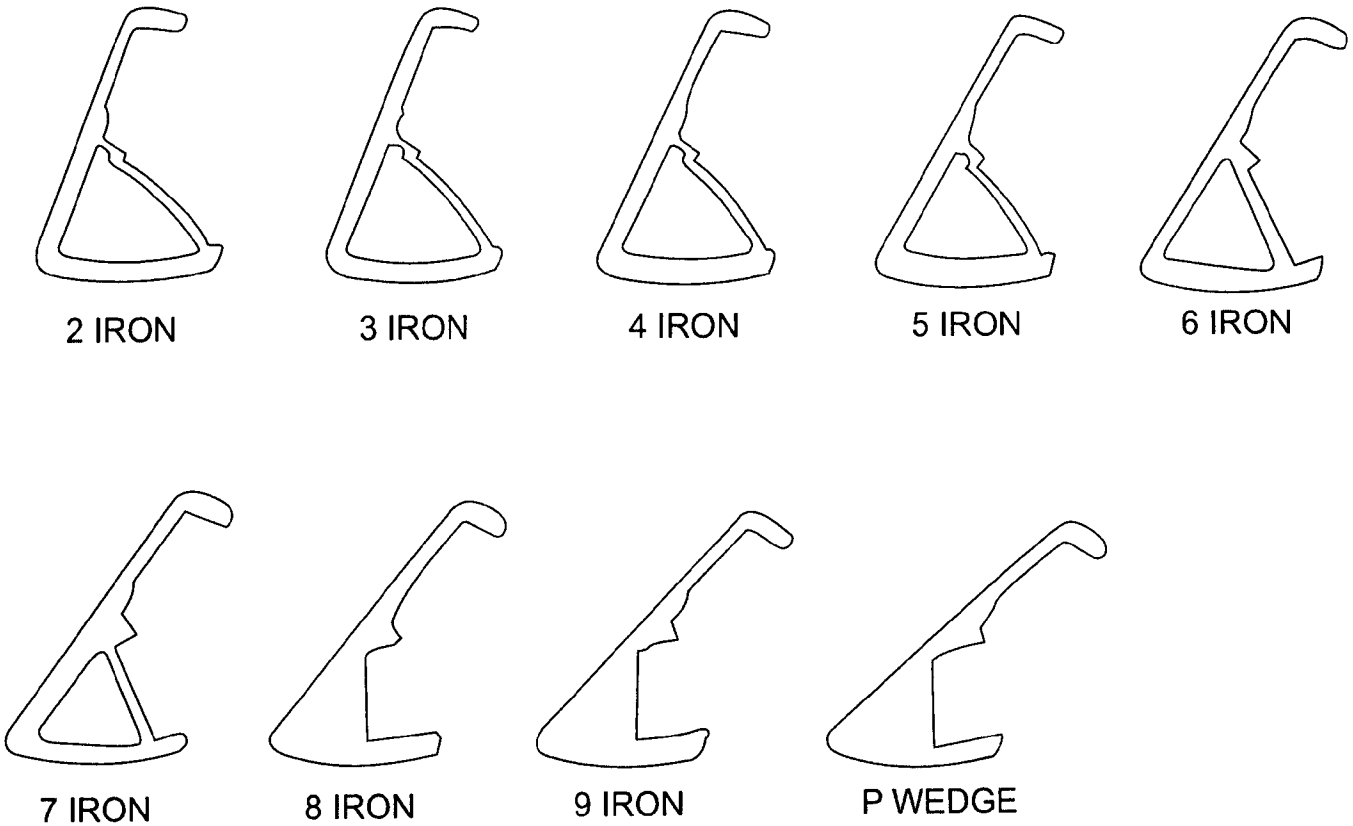
FIG. 3 shows cross-sectional views through each of a plurality of iron-type golf club heads of a set of golf clubs of the present invention.

FIG. 3 shows cross-sectional views through each of a plurality of iron-type golf club heads of a set of golf clubs of the present invention. The loft angle α increases from the 2-iron through the pitching wedge. Some of the club heads have a hollow space 40, and some of the club heads do not have a hollow space 40. In the illustrated embodiment, the clubs including a hollow space 40 are the 2-iron, 3-iron, 4-iron, 5-iron, 6-iron, and 7-iron, while the 8-iron, 9-iron, and pitching wedge do not have a hollow space 40.

Figure 4:
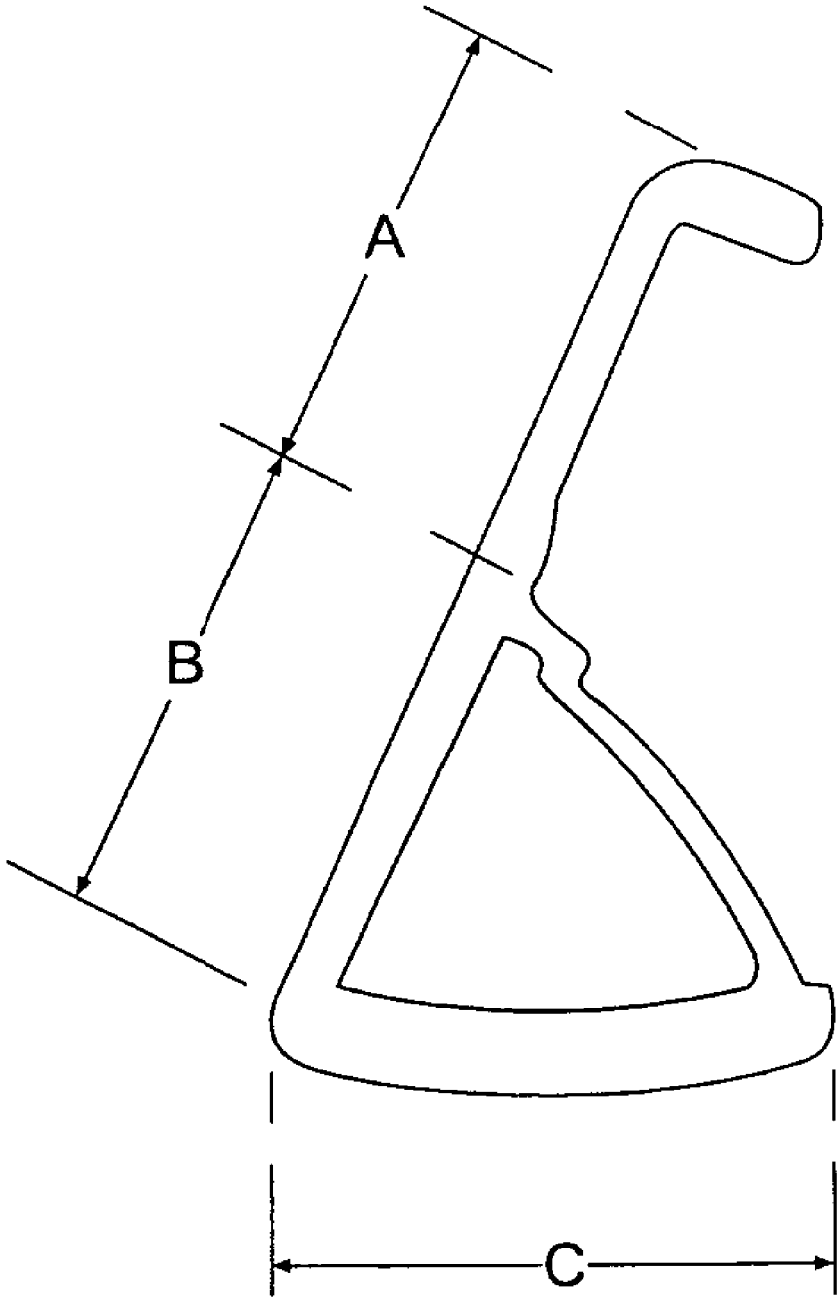
FIG. 4 shows a cross-sectional view through a representative hollow club of the set of golf clubs of FIG. 3.

FIG. 4 shows a cross-sectional view through a representative hollow club of the set of FIG. 3. Several dimensions are referenced in FIG. 3. Exemplary, non-limiting values for these dimensions are provided in Table 1 below.

TABLE 1

| | 2i | 3i | 4i | 5i | 6i | 7i | 8i | 9i | PW |
|---|---|---|---|---|---|---|---|---|---|
| A | 0.94 | 0.94 | 0.94 | 0.94 | 0.94 | 0.94 | 0.94 | 0.94 | 0.94 |
| B | 0.84 | 0.86 | 0.90 | 0.93 | 0.96 | 1.00 | 1.02 | 1.06 | 1.10 |
| C | 1.10 | 1.10 | 1.09 | 1.08 | 1.08 | 1.08 | 1.04 | 1.05 | 1.07 |
| Cav. Vol. | 0.69 | 0.69 | 0.64 | 0.55 | 0.42 | 0.34 | — | — | — |

Units for dimensions A-C are inches, and units for the cavity volume are cubic inches.

In the illustrated embodiment, the volume of the hollow space 40 is varied by the decreasing the loft angle α and by varying the rear wall 30 position and orientation. Typical loft angle values are provided in Table 2 below. The width of the sole 20 (dimension C) and the distance from the upper junction 32 to the top of the club head (dimension A) are substantially constant throughout the set. As used here, substantially constant means the sole widths are all within 0.1 inch of each other or that the sole width does not change by more than 0.05 inch between adjacent clubs in the set. The distance from the leading edge 12 to the rear wall—sole junction 22 gradually decreases from the 2-iron to the 7-iron, or with an increase in loft angle.

TABLE 2

| | 2i | 3i | 4i | 5i | 6i | 7i | 8i | 9i | PW |
|---|---|---|---|---|---|---|---|---|---|
| Men's | 18° | 20° | 23° | 26° | 29° | 33° | 37° | 41° | 45° |
| Women's | — | — | 24.5° | 27° | 30° | 34° | 37° | 41° | 45° |

The above dimensions alter the center of gravity location and the moments of inertia. This makes the long irons easier to hit, while maintaining the distance of the resulting golf shot. The center of gravity locations and moments of inertia are provided below in table 3. The moments of inertia are about a vertical axis passing through the center of gravity. The axes are oriented as follows: the origin is at the toe end of the leading edge 12, the x-axis is perpendicular to the page, the y-axis is vertical, and the z-axis is horizontal.

TABLE 3

| | 2i | 3i | 4i | 5i | 6i | 7i | 8i | 9i | PW |
|---|---|---|---|---|---|---|---|---|---|
| CGx | 1.41 | 1.41 | 1.41 | 1.41 | 1.41 | 1.41 | 1.39 | 1.39 | 1.39 |
| CGy | 0.79 | 0.77 | 0.76 | 0.75 | 0.75 | 0.73 | 0.69 | 0.69 | 0.66 |
| CGz | 0.47 | 0.48 | 0.49 | 0.5 | 0.5 | 0.5 | 0.47 | 0.49 | 0.5 |
| Iyy | 2500 | 2510 | 2540 | 2570 | 2610 | 2640 | 2610 | 2660 | 2660 |

where CGx is the x-coordinate of the center of gravity, CGy is the y-coordinate of the center of gravity, CGz is the z-coordinate of the center of gravity, and Iyy is the moment of inertia about the y-axis. The coordinates units are inches, and the moments of inertia units are $g \cdot cm^2$.

EXAMPLE 2

Figure 5:
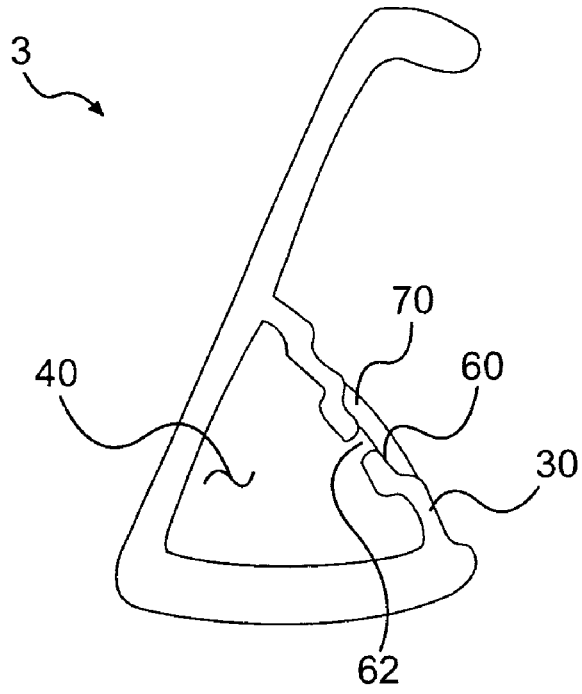
FIG. 5 shows a cross-sectional view through a second representative hollow club head of a set of golf clubs of the present invention.
Figure 6:
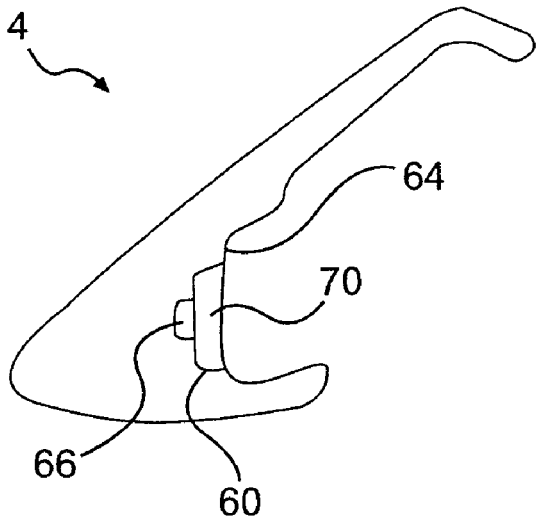
FIG. 6 shows a cross-sectional view through a second representative solid club head of a set of golf clubs of the present invention.

FIG. 5 shows a cross-sectional view through a second representative hollow club head 3 of a set of golf clubs of the present invention, and FIG. 6 shows a cross-sectional view through a second representative solid club head 4 of a set of golf clubs of the present invention. Each of the club heads 3 and 4 contains a recess 60 and an insert 70 positioned therein. The insert 70 can take any desired form, and preferably is a medallion. Medallions are useful for providing brand and model information. The insert 70 may be made of plastic, such as co-molded plastic, or a metallic material, such as stainless steel, or any other appropriate material or composition. The insert may be used to further manipulate the club head center of gravity location. The recess 60 and insert 70 are configured to matingly couple, such that the outer surface of the insert 70 is consistent with and provides a virtually seamless transition with the outer surface of the club head.

All of the hollow golf club heads in the set may contain recesses 60 and inserts 70, or only a portion of the hollow club heads in the set may be provided with them. Preferably, at least the 2-iron through 5-iron include recesses 60 and inserts 70.

For the hollow club heads 3, the recess 60 is provided in the rear wall 30. The recess 60 may contain an opening 62 therein, or it may be solid. If an opening 62 is provided, it is covered by the insert 70, creating a hollow space 40.

All of the solid golf club heads in the set may contain recesses 60 and inserts 70, or only a portion of the solid club heads in the set may be provided with them. Preferably, at least any wedges included with the set include recesses 60 and inserts 70.

For the solid club heads 4, the recess 60 is provided in a rear surface 64 of the club head 4. A pocket 66 optionally may be provided in recess 60. The pocket 66 removes material, reducing the weight of the club head 4. Inclusion of the pocket 60 with some or all of the club heads 4 may be used to counterbalance the addition of weight due to the inclusion of insert 70. In this manner, identical medallions (for example) can be used with each of the club heads 4, eliminating the need for a custom medallion for each club head. The volume and shape of the pocket 66 will likely be varied among the club heads.

EXAMPLE 3

Figure 7:
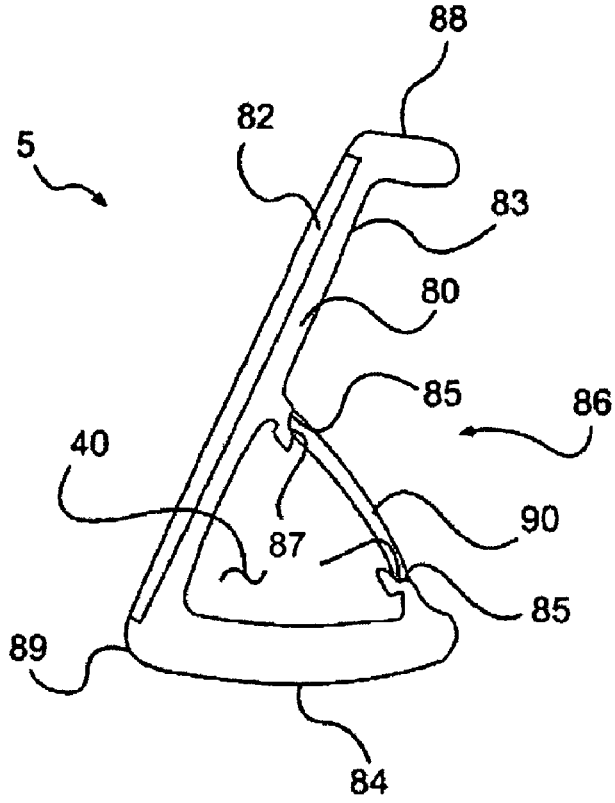
FIG. 7 shows a cross-sectional view through a third representative hollow club head of a set of golf clubs of the present invention.
Figure 8:
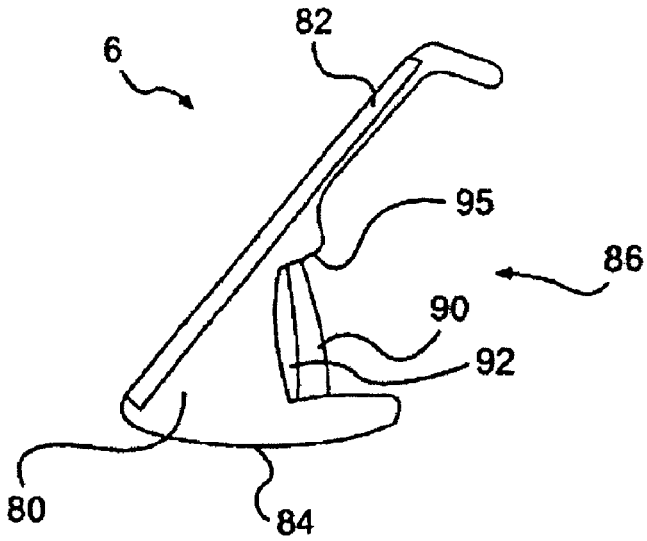
FIG. 8 shows a cross-sectional view through a third representative solid club head of a set of golf clubs of the present invention.

FIG. 7 shows a cross-sectional view through a third representative hollow club head 5 of a set of golf clubs of the present invention, and FIG. 8 shows a cross-sectional view through a third representative solid club head 6 of a set of golf clubs of the present invention. Each of the club heads 5 and 6 contains a body 80 having a face 82, a sole 84, and a back 86. The faces 82 define loft angles for the club heads 5 and 6, and the backs 86 include a composite material. The faces 82 and/or the soles 84 may be unitary with the body 80, or they may be separate bodies, such as inserts, coupled thereto. This allows the use of different materials for different portions of the club head 5, 6. For example, since the body 80 may be customized to suit a particular golfer's needs, it may preferably be made of steel, and since the face 82 is subjected to repeated impacts with a golf ball, it may preferably be made of titanium. Suitable composite materials include, for example, various resins combined with matrix material, such as graphite or a thermoplastic or thermoset material combined with fibers formed at least in part of carbon, fiber glass, or a ceramic. Combinations of these exemplary materials may also be used.

Regarding the hollow club heads 5, the back 86 extends between the sole 84 and a rear surface 83 opposite the front wall defining the face 82 between the club head top line 88 and the leading edge 89 to define a hollow space 40. Preferably, the back 86 extends from a rearward-most portion of the sole 84, although there may be some amount of sole overhang behind the back 86. The back 86 preferably contains a metallic material that may be unitarily formed with the body 80. The metallic material of the back 86 may contain an interior wall 85 defining a hole through the back 86 into the hollow space 40. The composite material may be provided in the form of an insert 90 coupled to the interior wall 85 such that the insert 90 covers the hole. The interior wall 85 may include a ledge 87 upon which a portion of the insert 90 rests. The ledge 87 helps support the insert 90. The insert 90 may or may not be coupled to the ledge 87.

Removal of body material in the back 86 inherently repositions the club head weight toward the perimeter, further increases the club MOI and producing a more forgiving club with a softer feel. The composite inserts 90 do not upset this mass redistribution, since the composite material is low in density. The inserts 90 support the face 82 during impact with the golf ball.

Regarding the solid club heads 6, the back 86 contains a recess 95 to provide further perimeter weighting and to enhance playability and forgiveness of the club. A composite insert 90 may be positioned within the recess 95. Use of the composite insert 90 provides a consistent look throughout the iron-type clubs of the set. The insert 90 may also be used in conjunction with a damper 92 to reduce any vibrations generated during use of the golf club and to further increase the playability and feel of the golf club. The damper 92, which may be formed of an elastomeric material, is preferably intermediate an internal surface of the recess 95 and the composite insert 90. This positioning allows the damper to dissipate unwanted vibrations while still providing a club with a solid fee.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. An iron type golf club head, comprising:

a body having a front wall defining a face and a rear surface opposite said face, a sole, and a rear wall; wherein:

said rear wall comprises an insert comprised of composite material, said composite material being spaced from said rear surface;

said face extends between a top line and a leading edge; and the insert extends between an upper and lower junction;

wherein the upper junction is coupled to the rear surface opposite the face to define an enclosed lower rear cavity;

a first end of said insert is attached to the upper junction proximate the rear surface opposite said face and a second end of said insert is attached to the lower junction proximate the sole;

wherein the rear surface opposite said face, upper junction, sole and lower junction form an integral body;

wherein an upper cavity extends from the upper junction towards the top line;

wherein the club head has a center of gravity that is less than 0.8 inch from said sole.

2. The golf club head of claim 1, wherein said rear wall extends from a rearward-most portion of said sole.

3. The golf club head of claim 1, wherein said rear wall comprises:

a metallic material with an interior wall; and an insert comprising said composite material coupled to said interior wall.

4. The golf club head of claim 3, wherein said interior wall includes a ledge upon which a portion of said insert rests.

5. The golf club head of claim 4, wherein said insert is coupled to said ledge.

6. The golf club head of claim 3, wherein said metallic material contains a hole therethrough and said insert covers said hole.

7. The golf club head of claim 3, wherein said interior wall spans a continuous perimeter surface, said insert being coupled to said continuous perimeter surface.

8. The golf club head of claim 1, wherein said composite includes one or more of carbon fiber, graphite, fiber reinforced resin, thermoplastic resin, thermosetting resin, and combinations thereof

9. The golf club head of claim 1, wherein said face includes an insert having grooves therein.

10. The golf club head of claim 1, wherein the club head has a center of gravity and a moment of inertia as measured about a vertical axis passing through said center of gravity that is within the range of approximately 2300 $g \cdot cm^2$ to approximately 2900 $g \cdot cm^2$.

11. The golf club head of claim 1, wherein the club head has a center of gravity that is from approximately 0.4 inch to approximately 0.6 inch behind said face.

12. The golf club head of claim 1, wherein said rear wall further comprises a metallic portion, said metallic portion extending to and being in contact with said rear surface.

13. The golf club head of claim 12, wherein said metallic portion contains a hole therethrough defining an interior wall, said interior wall spaced from said rear surface, said composite material coupled to said interior wall.

14. The golf club head of claim 1, wherein:

said metallic portion contains a hole therethrough defining a first interior wall and a second interior wall; and said composite material being in the form of an insert coupled to said first and second interior walls.

15. The golf club head of claim 14, wherein:

said first interior wall is angled relative an outer surface of said rear wall; and said second interior wall is stepped inward from said outer surface.

16. The golf club head of claim 1, wherein the lower junction is coupled to the sole between a leading edge and a trailing edge.

17. The golf club head of claim 1, wherein the upper junction is located at least 0.84 inches from the leading edge.

18. The golf club head of claim 1, wherein the upper junction is located 0.94 inches from the top line.

* * * * *